US010559243B2

(12) United States Patent
Li et al.

(10) Patent No.: US 10,559,243 B2
(45) Date of Patent: Feb. 11, 2020

(54) PIXEL DRIVING CIRCUIT AND DRIVING METHOD THEREOF, ARRAY SUBSTRATE AND DISPLAY DEVICE

(71) Applicant: BOE TECHNOLOGY GROUP CO., LTD., Beijing (CN)

(72) Inventors: Yongqian Li, Beijing (CN); Pan Xu, Beijing (CN); Quanhu Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 175 days.

(21) Appl. No.: 15/579,432

(22) PCT Filed: Jun. 2, 2017

(86) PCT No.: PCT/CN2017/086952
§ 371 (c)(1),
(2) Date: Dec. 4, 2017

(87) PCT Pub. No.: WO2017/211229
PCT Pub. Date: Dec. 14, 2017

(65) Prior Publication Data

US 2019/0228696 A1 Jul. 25, 2019

(30) Foreign Application Priority Data

Jun. 7, 2016 (CN) ..... 2016 1 0403525

(51) Int. Cl.
*G09G 3/20* (2006.01)
*G09G 3/22* (2006.01)

(52) U.S. Cl.
CPC ..... *G09G 3/2003* (2013.01); *G09G 3/22* (2013.01); *G09G 2300/0809* (2013.01); *G09G 2320/0233* (2013.01)

(58) Field of Classification Search
CPC ..... G09G 3/32; G09G 3/3208; G09G 3/3225; G09G 3/3233
See application file for complete search history.

(56) References Cited

U.S. PATENT DOCUMENTS

2009/0189161 A1* 7/2009 Honda ..... G09G 3/3233 257/72
2010/0090203 A1* 4/2010 Obata ..... H01L 27/3246 257/40

(Continued)

FOREIGN PATENT DOCUMENTS

CN 102056361 A 5/2011
CN 102403430 A 4/2012

(Continued)

OTHER PUBLICATIONS

Xiaomu Wang et al., A spectrally tunable all-graphene-based flexible field-effect light emitting device, Nature Communications, published Jul. 16, 2015, 6 pages, DOI:10.1038/ncomms8767, Bejing, China.

(Continued)

*Primary Examiner* — Kenneth Bukowski
(74) *Attorney, Agent, or Firm* — Dilworth & Barrese, LLP.; Michael J. Musella, Esq.

(57) ABSTRACT

A pixel driving circuit and a driving method thereof, an array substrate and a display device are provided. The pixel driving circuit includes: a color data write unit, a luminance control unit, and a graphene light-emitting device. The graphene light-emitting device can emit light under the control of a color data signal and a luminance control signal. The driving method of a pixel driving circuit is conducted to drive the pixel driving circuit.

18 Claims, 3 Drawing Sheets

(56) References Cited

U.S. PATENT DOCUMENTS

| | | | | |
|---|---|---|---|---|
| 2012/0049239 | A1 | 3/2012 | Sung | |
| 2012/0068152 | A1 | 3/2012 | Hwang et al. | |
| 2013/0256629 | A1* | 10/2013 | Lee | H01L 27/283 257/13 |
| 2017/0256679 | A1* | 9/2017 | Fan | G09G 5/02 |
| 2018/0081241 | A1 | 3/2018 | Fan | |
| 2018/0277711 | A1* | 9/2018 | Fan | H01L 33/0041 |

FOREIGN PATENT DOCUMENTS

| | | | |
|---|---|---|---|
| CN | 103474425 | A | 12/2013 |
| CN | 104124348 | A | 10/2014 |
| CN | 105047138 | A | 11/2015 |
| CN | 105303985 | A | 2/2016 |
| CN | 105607346 | A | 5/2016 |
| CN | 105869574 | A | 8/2016 |

OTHER PUBLICATIONS

Internatian Search Report dated Aug. 25, 2017.

* cited by examiner

PIXEL DRIVING CIRCUIT AND DRIVING METHOD THEREOF, ARRAY SUBSTRATE AND DISPLAY DEVICE

TECHNICAL FIELD

Embodiments of the present disclosure relate to a pixel driving circuit and a driving method thereof, an array substrate, and a display device.

BACKGROUND

With the continuous development of the display technology, more and more display devices are applied in human's life. These display devices display images usually through emitting light of corresponding colors by a plurality of pixel units which the display devices comprise. However, the color of the light emitted by a light-emitting device has been fixed after finishing the manufacturing of the light-emitting device (devices such as organic light-emitting diodes and the like, which can convert electrical energy to light energy). Each pixel unit usually comprises several sub-pixel units, and each sub-pixel unit corresponds to a light-emitting device emitting light of one color. Therefore, light emitted by several sub-pixel units can be mixed to form the light with the color that the pixel unit is intended to emit through controlling the luminance of the light emitted by respective sub-pixel units, so that the display device can perform to display different images.

However, because the luminance of the light emitted by each sub-pixel unit is controlled by its corresponding pixel driving circuit, in the case where one pixel unit corresponds to three sub-pixel units, the pixel unit needs the driving circuits corresponding to three sub-pixels. The more pixel units the display device comprises, the more pixel driving circuits the display device needs correspondingly, which causes a problem of high complexity in the display panel of the display device.

SUMMARY

At least one of the embodiments of the present disclosure provides a pixel driving circuit, comprising: a color data write unit, a luminance control unit, and a graphene light-emitting device which is connected with the color data write unit and the luminance control unit; the color data write unit is operative to output a color data signal to a control end of the graphene light-emitting device; the luminance control unit is operative to receive a luminance data signal and control a value of a current signal passing the graphene light-emitting device according to the luminance data signal; the graphene light-emitting device is operative to be driven to emit light by the color data signal and the current signal.

At least one of the embodiments of the present disclosure provides a driving method of a pixel driving circuit and the pixel driving circuit comprises a color data write unit, a luminance control unit, and a graphene light-emitting device which is connected with the color data write unit and the luminance control unit; the driving method comprises driving cycles and each driving cycle comprises: a color-data-writing period, during which the color data write unit transmits a color data signal to a control end of the graphene light-emitting device; a luminance-controlling period, during which the luminance control unit receives a luminance data signal and controls a value of a current signal passing the graphene light-emitting device according to the luminance data signal; a light-emitting period, during which the graphene light-emitting device is driven to emit light by the color data signal and the current signal.

At least one of the embodiments of the present disclosure provides an array substrate, comprising the above-mentioned pixel driving circuit.

At least one of the embodiments of the present disclosure provides a display device, comprising the above-mentioned array substrate.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

REFERENCE NUMBERS

Figure 1:
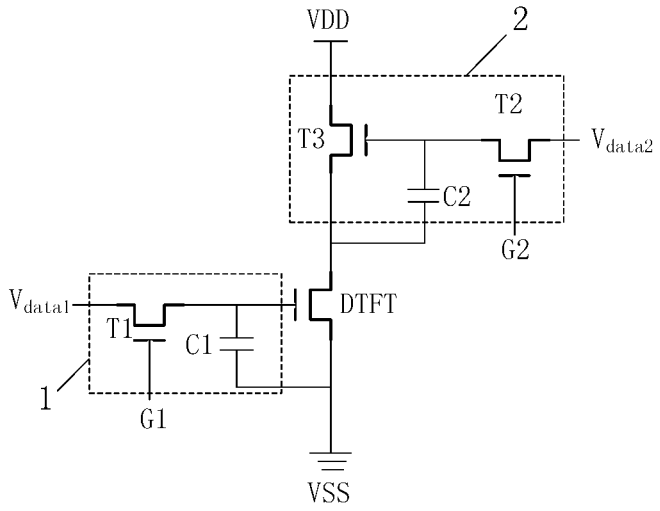
FIG. 1 illustrates a first example of a pixel driving circuit provided by an embodiment of the present disclosure.

1—color data write unit, 2—luminance control unit, 3—base control unit, S1—base control signal, DTFT—graphene light-emitting device, T1—first switch transistor, T2—second switch transistor, T3—third switch transistor, T4—fourth switch transistor, VDD—second power voltage input terminal, VSS—first power voltage input terminal, C1—first storage capacitor, C2—second storage capacitor, G1—first gate control signal, G2—second gate control signal, $V_{data1}$—color data signal, $V_{data2}$—luminance control signal, $V_{ref}$—base signal.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Detailed description will be given below in connection with the accompanying drawings, in order to further illustrate the pixel driving circuit and the driving method thereof, the array substrate and the display device provided by embodiments of the present disclosure.

First of all, brief description is given about the graphene light-emitting device DTFT used in the pixel driving circuit. The graphene light-emitting device DTFT is a type of light-emitting device, of which the emission wavelength can be tuned with a voltage, and the emission wavelength can be continuously tuned in the range of 450 nm-750 nm. A graphene material in a partial-reduced state is used in the graphene light-emitting device DTFT, and the fermi level of the graphene material in the partial-reduced state can be tuned through applying a voltage to the gate electrode of the graphene light-emitting device DTFT, so that the emission wavelength of the graphene light-emitting device DTFT can be tuned in real time. Furthermore, for example, the input end and the output end of the graphene light-emitting device DTFT corresponds to the drain electrode and the source electrode of the graphene light-emitting device DTFT, and can be elected according to the actual application situation of the graphene light-emitting device DTFT as long as the graphene light-emitting device DTFT can operate normally. In addition, this type of graphene light-emitting device DTFT has characteristics such as high luminance, comparability for applying to flexible devices and so on. More details can be referred to the article by Tianling Ren, Professor of Tsinghua University, entitled "A spectrally tunable all-graphene-based flexible field-effect light-emitting device" (Wang, X. et al. A spectrally tunable all-graphene-based flexible field-effect light-emitting device. Nat. Commun. 6:7767 doi: 10.1038/ncomms8767 (2015)), the entire disclosure of which is incorporated herein by reference.

Referring to FIG. 1, at least one of the embodiments of the present disclosure provides a pixel driving circuit, comprising: a color data write unit 1, a luminance control unit 2, and a graphene light-emitting device DTFT which is connected with both the color data write unit 1 and the luminance control unit 2.

The color data write unit 1 is operative to output a color data signal $V_{data1}$ to a control end of the graphene light-emitting device; the luminance control unit 2 is operative to receive a luminance data signal $V_{data2}$ and control the value of the current signal passing the graphene light-emitting device DTFT according to the luminance data signal $V_{data2}$; the graphene light-emitting device DTFT is operative to be driven to emit light by the color data signal $V_{data1}$ and the above-mentioned current signal.

It should be noted here that the color data signal $V_{data1}$ (corresponding to a voltage signal) indicates the color of the light that is supposed to be emitted by the light-emitting device DTFT, and the luminance data signal $V_{data2}$ (corresponding to a voltage signal) indicates the luminance of the light that is supposed to be emitted by the light-emitting device DTFT.

A driving method of the above-mentioned pixel driving circuit can comprise the following: during a color-data-writing period, the color data write unit 1 transmits the color data signal $V_{data1}$ to a control end of the graphene light-emitting device DTFT; during the luminance-controlling period, the luminance control unit 2 receives the luminance data signal $V_{data2}$ and controls a value of a current signal passing the graphene light-emitting device DTFT according to the luminance data signal $V_{data2}$; and during the light-emitting period, the graphene light-emitting device DTFT is driven to emit light by the color data signal $V_{data1}$ and the current signal.

In the pixel driving circuit provided by an embodiment of the present disclosure, the used graphene light-emitting device DTFT is a spectrum tunable light-emitting device, of which the spectrum can be tuned through a gate voltage, that is, the emission wavelength of the graphene light-emitting device DTFT can be tuned with a voltage so that the graphene light-emitting device DTFT can emit light of different colors, so the color data signal $V_{data1}$ is output to the graphene light-emitting device DTFT through the color data write unit 1. The electrical current signal of the graphene light-emitting device DTFT is controlled by the luminance control unit 2 according to the luminance data signal $V_{data2}$ and the current signal is operative to control the luminance of the light emitted by the graphene light-emitting device DTFT. In this way, the graphene light-emitting device DTFT can be driven to emit light with the desired color and luminance by way of the color data signal $V_{data1}$ and the current signal. When this type of graphene light-emitting device DTFT is employed as a pixel unit in a display device, the pixel can be driven to emit light of different desired colors and luminance by the color data signal $V_{data1}$ and the luminance data signal $V_{data2}$ and therefore there is no need any more to mix light emitted by several sub-pixel units, each of which emits light with a fixed color, to obtain desired light. Furthermore, each pixel unit needs to correspond to only one pixel driving circuit, so that the pixel driving circuit corresponding to each pixel unit is optimized and the power consumption is reduced as well. The number of the pixel driving circuits needed for a display device is reduced, so that the problem of high complexity in the display panel of the display device due to too many pixel driving circuits is resolved.

Additionally, because each pixel unit corresponds to only one graphene light-emitting device DTFT, and each pixel unit needs to correspond to only one pixel driving circuit, the usable space of the display panel becomes larger, the number of pixel driving circuits of the display panel can be increased, the display device can perform to display images with a higher display resolution, and the images displayed can possess higher realism, and the display device can achieve a better display effect as a result.

Each of the above-mentioned color data write unit 1 and luminance control unit 2 can have several types of circuit structures. As follows are given specific structures of the color data write unit 1 and the luminance control unit 2 to illustrate the specific work process of the driving circuit in detail.

With further reference to FIG. 1, in one embodiment, the color data write unit 1 comprises a first switch transistor T1 and a first storage capacitor C1. A control end of the first switch transistor T1 is used to receive a first gate control signal G1, an input end of the first switch transistor T1 is used to receive the color data signal $V_{data1}$, that is, an input end of the first switch transistor T1 is connected with a data line which controls the color of the light; and an output end of the first switch transistor T1 is connected with a control end of the graphene light-emitting device DTFT. One end of the first storage capacitor C is connected with the output end of the first switch transistor T1, and the other end of the first storage capacitor C1 is connected with a first power voltage input terminal VSS.

When the color data write unit 1 is in operation, during a color-data-writing period, the first switch transistor T1 is switched on and the color data signal $V_{data1}$ is transmitted to the graphene light-emitting device DTFT and the first storage capacitor C1 under the control of the first gate control signal G1. The first storage capacitor C1 stores the color data signal $V_{data1}$, which allows the graphene light-emitting device DTFT to emit light with a corresponding color. During a light-emitting period, the first switch transistor T1 is switched off under the control of the first gate control signal G1, and the color of the light emitted by the graphene light-emitting device DTFT is maintained by the color data signal $V_{data1}$ stored in the first storage capacitor C1.

In an example of the above-mentioned embodiment, the luminance control unit 2 comprises a second switch transistor T2, a third switch transistor T3 and a second storage capacitor C2, and the luminance control unit 2 can be incorporated into the pixel driving circuit in several ways. Two incorporating ways are descried as follows for example.

Figure 2:
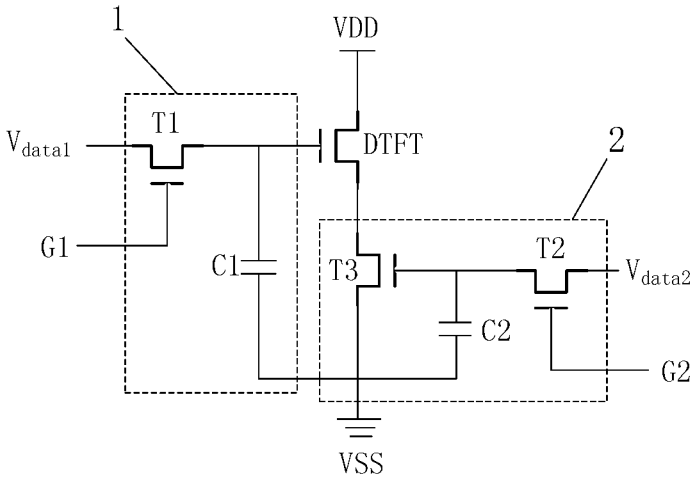
FIG. 2 illustrates a second example of a pixel driving circuit provided by an embodiment of the present disclosure.

A first incorporating way is referred to FIG. 2, in which a control end of the second switch transistor T2 is used to receive a second gate control signal G2, and an input end of the second switch transistor T2 is used to receive the luminance data signal $V_{data2}$, that is, the input end of the second switch transistor T2 is connected with a data line for controlling the luminance; and an output end of the second switch transistor T2 is connected with a control end of the third switch transistor T3; an input end of the third switch transistor T3 is connected with an output end of the graphene light-emitting device DTFT, an output end of the third switch transistor T3 is connected with a first power voltage input terminal VSS, and the third switch transistor T3 is operative to control the value of the electrical current signal passing the graphene light-emitting device T3 according to the luminance data signal $V_{data2}$; one end of the second storage capacitor C2 is connected with the control end of the third switch transistor T3, and the other end of the second storage capacitor C2 is connected with the output end of the third switch transistor T3. Further, in this incorporating way, the input end of the graphene light-emitting device DTFT is connected with a second power voltage input terminal VDD, that is, can receive a power voltage signal. It should be noted that the above-mentioned second power voltage input terminal VDD is a high voltage input terminal, and the first power voltage input terminal VSS is a low voltage input terminal.

A second incorporating way is referred to FIG. 1, in which a control end of the second switch transistor T2 is used to receive a second gate control signal G2, an input end of the second switch transistor T2 is used to receive the luminance data signal $V_{data2}$, and an output end of the second switch transistor T2 is connected with a control end of the third switch transistor T3; an input end of the third switch transistor T3 is connected with a second power voltage input terminal VDD, that is, can receive a power voltage signal. An output end of the third switch transistor T3 is connected with an input end of the graphene light-emitting device DTFT, and the third switch transistor T3 is operative to control a value of an electrical current signal of the graphene light-emitting device according to the luminance data signal $V_{data2}$. One end of the second storage capacitor C2 is connected with the control end of the third switch transistor T3, and the other end of the second storage capacitor C2 is connected with the output end of the third switch transistor T3. Further, in this incorporating way, the input end of the graphene light-emitting device DTFT is connected with a first power voltage input terminal VSS.

When the luminance control unit 2 is in operation, during a luminance-controlling period, the second switch transistor T2 is switched on, and the luminance data signal $V_{data2}$ are transmitted to the third switch transistor T3 and the second storage capacitor C2 under the control of the second gate control signal G2. The second storage capacitor C2 stores the luminance data signal $V_{data2}$ and the third switch transistor T3 controls the value of the current signal passing the graphene light-emitting device DTFT according to the luminance data signal $V_{data2}$. Specifically, the third switch transistor T3 controls the value of the current signal of the graphene light-emitting device DTFT according to the received luminance data signal $V_{data2}$ and enables the graphene light-emitting device DTFT to emit light with a corresponding luminance under the driving of the current signal. During the light-emitting period, the second switch transistor T2 is switched off under the control of the second gate control signal G2, and the current signal passing the graphene light-emitting device DTFT is continuously controlled by the luminance data signal $V_{data2}$ stored in the second storage capacitor C2, so as to maintain the luminance of the light with a certain color that is emitted by the graphene light-emitting device DTFT.

Because the graphene light-emitting device DTFT used in the above-mentioned pixel driving circuits has parasitic capacitance in itself, and the parasitic capacitance can affect the color data signal $V_{data1}$ that is received actually by the graphene light-emitting device DTFT and also affect the current signal that is under the control of the luminance data signal $V_{data2}$. In this case, even if the display device is input with the same color data signal $V_{data1}$ and the same luminance data signal $V_{data2}$, the luminance non-uniformity of displayed images is caused to the display device due to the difference of the parasitic capacitances among different graphene light-emitting devices DTFT. In order to avoid the influence of the parasitic capacitance, preferably, the luminance control unit 2 is incorporated into the pixel driving circuit in the first way as mentioned above, so that the input end of the graphene light-emitting device DTFT can receive the power voltage signal directly. Because the power voltage signal is at a stable voltage value, the potential of the input end of the graphene light-emitting device DTFT is controlled at a stable potential, which prevents the potential of the input end of the graphene light-emitting device DTFT from being affected by the voltage division incurred by the parasitic capacitance. In this way, the color data signal $V_{data1}$ and the current signal that are received actually by the graphene light-emitting device DTFT are not affected by the parasitic capacitance, and when the display device is input with the same color data signal $V_{data1}$ and the same luminance data signal $V_{data2}$, luminance non-uniformity of displayed images by the display device due to the difference of the parasitic capacitances among different graphene light-emitting devices DTFT is prevented.

Figure 3:
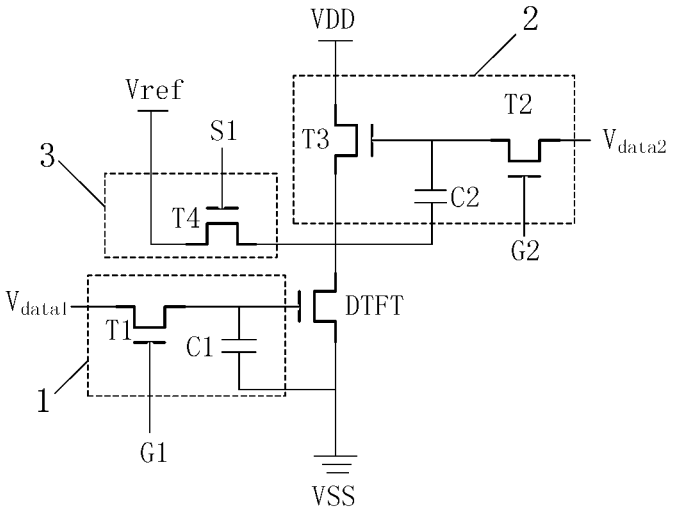
FIG. 3 illustrates a third example of a pixel driving circuit provided by an embodiment of the present disclosure.

Of course, when the luminance control unit 2 is incorporated into the pixel driving circuit in the second way as mentioned above, measures can be taken to avoid the influence of the parasitic capacitance. Referring to FIG. 3, in another embodiment, a base control unit 3 can be introduced to the pixel driving circuit, and the base control unit 3 is connected with the input end of the graphene light-emitting device DTFT. The base control unit 3 receives a base control signal S1 and a base signal $V_{ref}$, and during the luminance-controlling period, the base control unit 3 can output the base signal $V_{ref}$ to the input end of the graphene light-emitting device DTFT under the control of the base control signal $S_1$. The base signal $V_{ref}$ received by the base control unit 3 can be set to be a tunable low voltage, so that during the luminance-controlling period, the base control unit 3 can provide a relatively stable potential to the connection point where the second storage capacitor C2 and the graphene light-emitting device DTFT are connected with each other, which prevents the potential of the input end of the graphene light-emitting device DTFT from being affected by the voltage division incurred by the parasitic capacitance. In this way, the luminance data signal $V_{data2}$ can be more stably written into the luminance data signal $V_{data2}$ and the influence from the parasitic capacitance of the graphene light-emitting device DTFT can be better prevented.

Further with reference to FIG. 3, the base control unit 3 can be embodied in many structures. The following describes a specific structure to illustrate the specific work process of the base control unit 3 in detail. In one example of the above-mentioned embodiment, the base control unit 3 comprises a fourth switch transistor T4. A control end of the fourth switch transistor T4 is operative to receive the base control signal S1, an input end of the fourth switch transistor T4 is configured to receive the base signal $V_{ref}$, and an output end of the fourth switch transistor T4 is connected with the input end of the graphene light-emitting device DTFT. During the luminance-controlling period, the fourth switch transistor T4 is switched on under the control of the base control signal S1, and the base signal $V_{ref}$ is output to the input end of the graphene light-emitting device DTFT. During the light-emitting period, the fourth switch transistor T4 is switched off under the control of the base control signal S1 in order to guarantee the graphene light-emitting device DTFT can emit light normally.

It should be noted that the first switch transistor T1, the second switch transistor T2, the third switch transistor T3 and the fourth switch transistor T4 as mentioned-above can be embodied in kinds of devices, for example N-channel thin-film transistors, or other devices which can function as a controllable switch such as P-channel transistors. Furthermore, types of the transistors in one pixel driving circuit can be the same or different from each other, as long as the high voltage and the low voltage in the timing signal are adjusted according to the characteristic of threshold voltages $V_{th}$ of the transistors. Furthermore, once the basic principle of the above-mentioned pixel driving circuit is understood, the pixel driving circuits provided by the embodiments of the present disclosure can be easily modified into other circuits comprising devices functioning as a controllable switch. However, whatever kinds of devices are used to realize the driving function of the circuits, no substantial change is brought. Therefore, whatever kinds of devices used shall all fall within the scope of protection of the present disclosure, as long as they perform the driving function of the circuits according to the basic principle of the pixel driving circuits provided by the embodiments of the present disclosure.

At least one of the embodiments of the present disclosure provides a driving method of a pixel driving circuit which is operative to drive the above-mentioned pixel driving circuit. The driving method of the pixel driving circuit comprises driving cycles and each driving cycle comprises: a color-data-writing period, a luminance-controlling period and a light-emitting period.

During the color-data-writing period, the color data write unit transmits a color data signal to the control end of the graphene light-emitting device. For example, the first gate control signal G1 and the color data signal $V_{data1}$ are written into the color data write unit 1, so that the color data write unit 1 outputs the color data signal $V_{data1}$ to the graphene light-emitting device DTFT under control of the first gate control signal G1.

During the luminance-controlling period, the luminance control unit receives a luminance data signal and controls the value of the current signal of the graphene light-emitting device DTFT according to the luminance data signal $V_{data2}$. For example, the second gate control signal G2 and the luminance data signal $V_{data2}$ are input into the luminance control unit 2, so that the luminance control unit 2 controls the value of the current signal of the graphene light-emitting device DTFT according to the luminance data signal $V_{data2}$ under control of the second gate control signal G2.

During the light-emitting period, the graphene light-emitting device DTFT is driven to emit light by the color data signal $V_{data1}$ and the current signal.

Because the driving method of the pixel driving circuit provide by the embodiment of the present disclosure corresponds to the above-mentioned pixel driving circuit, the benefits which the driving method can bring about are the same as that the above-mentioned pixel driving circuit can bring about, which is not repeated here.

It should be noted that the color-data-writing period and the luminance-controlling period can be carried out concurrently or in sequence. For example, preferably, the color-data-writing period and the luminance-controlling period are carried out in sequence, and in this case, a buffer period can be inserted between the color-data-writing period and the luminance-controlling period. During the buffer period, the color data write unit 1 stops receiving the color data signal $V_{data1}$ under control of the first gate control signal G1. The inserted buffer period can provide a time period for buffering between the color-data-writing period and the luminance-controlling period, that is, when the color-data-writing period ends, the luminance-controlling period does not begin immediately, which prevents the crosstalk caused by concurrent signal transition in the color-data-writing period and the luminance-controlling period. In addition, the operation that the color data signal $V_{data1}$ and the luminance data signal $V_{data2}$ are written separately can prevent accidental interference factors, and eliminate mutual influences caused by the parasitic capacitance of the graphene light-emitting device DTFT during the writing of the color data signal $V_{data1}$ and the luminance data signal $V_{data2}$.

In the case where the luminance control unit is connected with an input end of the graphene light-emitting device, the pixel driving circuit can further comprise a base control unit; the base control unit is connected with the input end of the graphene light-emitting device, and the base control unit is operative to output a base signal to the input end of the graphene light-emitting device during the luminance-controlling period. Benefits that the base control unit brings about during the driving process of the pixel driving circuit have been illustrated in the description of the corresponding device structure and no details are repeated here.

In order to clearly illustrate the above-mentioned driving method of the pixel driving circuit, the following describes the detailed work processes of different types of structures of the pixel driving circuits in two cases, corresponding to the case in which the color-data-writing period and the luminance-controlling period are carried out concurrently, and the case in which the color-data-writing period and the luminance-controlling period are carried out in sequence.

Embodiment One

Referring to FIG. 2, the pixel driving circuit comprises: a color data write unit 1, a luminance control unit 2, and a graphene light-emitting device DTFT. The color data write unit 1 comprises a first switch transistor T1 and a first storage capacitor C1; a control end of the first switch transistor T1 is configured to receive a first gate control signal G1, an input end of the first switch transistor T1 is configured to receive a color data signal $V_{data1}$ (an input end of the first switch transistor T1 is connected with a color data line); and an output end of the first switch transistor T1 is connected with a control end of the graphene light-emitting device DTFT; one end of the first storage capacitor C1 is connected with the output end of the first switch transistor T1, and the other end of the first storage capacitor C1 is connected with a first power voltage input terminal VSS. The luminance control unit 2 comprises a second switch transistor T2, a third switch transistor T3, and a second storage capacitor C2; a control end of the second switch transistor T2 is configured to receive a second gate control signal G2, and an input end of the second switch transistor T2 is configured to receive the luminance data signal $V_{data2}$ (the input end of the second switch transistor T2 is connected with a luminance data line), and an output end of the second switch transistor T2 is connected with a control end of the third switch transistor T3; an input end of the third switch transistor T3 is connected with an output end of the graphene light-emitting device DTFT, an output end of the third switch transistor T3 is connected with a first power voltage input terminal VSS; one end of the second storage capacitor C2 is connected with the control end of the third switch transistor T3, and the other end of the second storage capacitor C2 is connected with the output end of the third switch transistor T3; the input end of the graphene light-emitting device DTFT is configured to receive a power voltage signal (e.g., the input end of the graphene light-emitting device DTFT is connected with a second power voltage input terminal VDD).

When the color-data-writing period and the luminance-controlling period are carried out concurrently, the driving method is described as follows.

Figure 4:
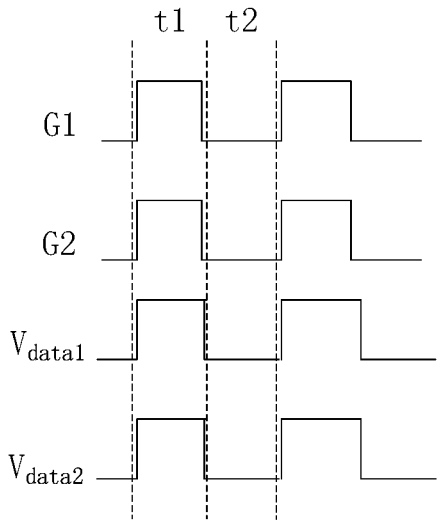
FIG. 4 illustrates a first sequence diagram provided by an embodiment of the present disclosure.

Referring to FIG. 4, during the time period t1, the first switch transistor T1 is switched on under the control of the first gate control signal G1, the color data signal $V_{data1}$ is transmitted to the graphene light-emitting device DTFT, and the first storage capacitor C1 is charged. Also, during the time period t1, the second switch transistor T2 is switched on under the control of the second gate control signal G2, the luminance data signal $V_{data2}$ is transmitted to the third switch transistor T3, and the second storage capacitor C2 is charged. The third switch transistor T3 adjusts the value of the current signal of the graphene light-emitting device DTFT under control of the luminance data signal $V_{data2}$.

During the time period t2, the first switch transistor T1 is switched off under the control of the second gate control signal G1, and the second switch transistor T2 is switched off under the control of the second gate control signal G2. The color data signal $V_{data1}$ stored in the first storage capacitor C1 and the luminance data signal $V_{data2}$ stored in the second storage capacitor C2 continue to maintain the luminance of the light with a certain color emitted by the graphene light-emitting device DTFT.

When the color-data-writing period and the luminance-controlling period are carried out in sequence, the driving method is described as follows.

Figure 6:
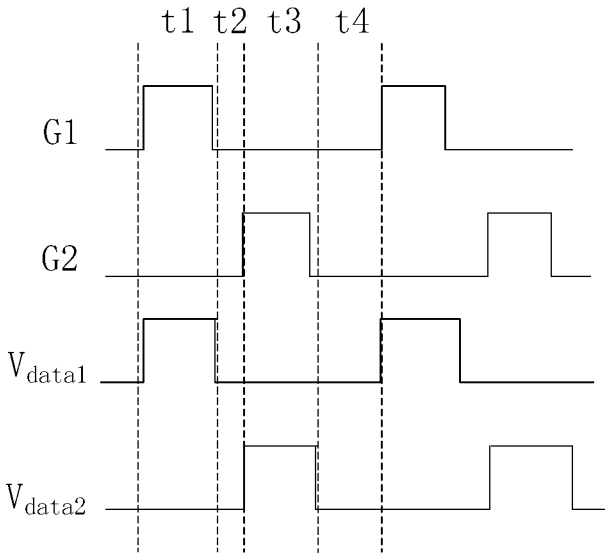
FIG. 6 illustrates a third sequence diagram provided by an embodiment of the present disclosure.

Referring to FIG. 6, during the time period t1, the first switch transistor T1 is switched on under the control of the first gate control signal G1, the color data signal $V_{data1}$ is transmitted to the graphene light-emitting device DTFT, and the first storage capacitor C is charged; and the second switch transistor T2 is switched off under the control of the second gate control signal G2.

During the time period t2 (corresponding to the buffer period), the first switch transistor T1 is switched off under the control of the first gate control signal G1, that is, the color data write unit 1 stops receiving the color data signal $V_{data1}$; and the second switch transistor T2 is switched off under the control of the second gate control signal G2.

During the time period t3, the first switch transistor T1 is switched off under the control of the first gate control signal G1; the second switch transistor T2 is switched on under the control of the second gate control signal G2, the luminance data signal $V_{data2}$ is transmitted to the third switch transistor T3, and the second storage capacitor C2 is charged. The third switch transistor T3 adjusts the value of the current signal of the graphene light-emitting device DTFT under control of the luminance data signal $V_{data2}$.

During the time period t4, the first switch transistor T1 is switched off under the control of the second gate control signal G1, and the second switch transistor T2 is switched off under the control of the second gate control signal G2. The color data signal $V_{data1}$ stored in the first storage capacitor C1 and the luminance data signal $V_{data2}$ stored in the second storage capacitor C2 continue to maintain the luminance of the light with a certain color emitted by the graphene light-emitting device DTFT.

Embodiment Two

Referring to FIG. 3, the pixel driving circuit comprises: a color data write unit 1, a luminance control unit 2, a base control unit 3, and a graphene light-emitting device DTFT. The color data write unit 1 comprises a first switch transistor T1 and a first storage capacitor C1; a control end of the first switch transistor T1 is operative to receive a first gate control signal G1, an input end of the first switch transistor T1 is operative to receive a color data signal $V_{data1}$ (an input end of the first switch transistor T1 is connected with a color data line); and an output end of the first switch transistor T1 is connected with a control end of the graphene light-emitting device DTFT; one end of the first storage capacitor C1 is connected with the output end of the first switch transistor T1, and the other end of the first storage capacitor C1 is connected with a first power voltage input terminal VSS. The luminance control unit 2 comprises a second switch transistor T2, a third switch transistor T3 and a second storage capacitor C2; a control end of the second switch transistor T2 is operative to receive a second gate control signal G2, and an input end of the second switch transistor T2 is operative to receive the luminance data signal $V_{data2}$ (the input end of the second switch transistor T2 is connected with a luminance data line), and an output end of the second switch transistor T2 is connected with a control end of the third switch transistor T3; an input end of the third switch transistor T3 is connected with a power voltage signal, and an output end of the third switch transistor T3 is connected with an input end of the graphene light-emitting device DTFT; one end of the second storage capacitor C2 is connected with the control end of the third switch transistor T3, and the other end of the second storage capacitor C2 is connected with the output end of the third switch transistor T3. The base control unit 3 comprises a fourth switch transistor T4. A control end of the fourth switch transistor T4 is operative to receive a base control signal S1, an input end of the fourth switch transistor T4 is operative to receive a base signal $V_{ref}$, and an output end of the fourth switch transistor T4 is connected with the input end of the graphene light-emitting device DTFT. The output end of the graphene light-emitting device DTFT is connected with the first power voltage input terminal VSS.

When the color-data-writing period and the luminance-controlling period are carried out concurrently, the driving method is described as follows.

Figure 5:
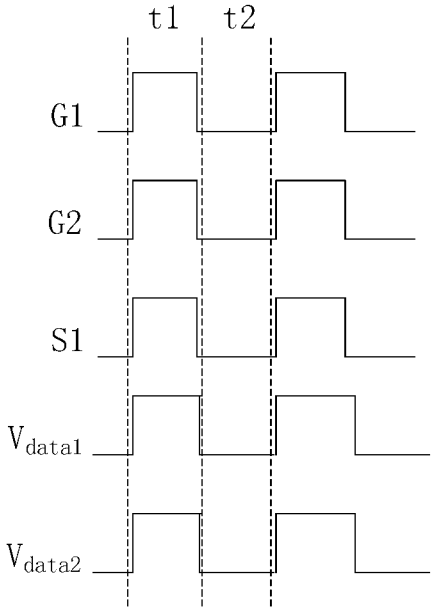
FIG. 5 illustrates a second sequence diagram provided by an embodiment of the present disclosure.

Referring to FIG. 5, during the time period t1, the first switch transistor T1 is switched on under the control of the first gate control signal G1, the color data signal $V_{data1}$ is transmitted to the graphene light-emitting device DTFT, and the first storage capacitor C1 is charged. Also, during the time period t1, the second switch transistor T2 is switched on under the control of the second gate control signal G2, the luminance data signal $V_{data2}$ is transmitted to the third switch transistor T3, and the second storage capacitor C2 is charged. The third switch transistor T3 adjusts the value of the current signal of the graphene light-emitting device DTFT under control of the luminance data signal $V_{data2}$. Furthermore, during the time period t1, the fourth transistor is switched on under control of the base control signal S1 and the base signal $V_{ref}$ is output to the input end of the graphene light-emitting device DTFT.

During the time period t2, the first switch transistor T1 is switched off under the control of the second gate control signal G1, the second switch transistor T2 is switched off under the control of the second gate control signal G2, and the fourth switch transistor T4 is switched off under the control of the base control signal S1. The color data signal $V_{data1}$ stored in the first storage capacitor C1 and the luminance data signal $V_{data2}$ stored in the second storage capacitor C2 continue to maintain the luminance of the light with a certain color emitted by the graphene light-emitting device DTFT.

When the color-data-writing period and the luminance-controlling period are carried out in sequence, the driving method is described as follows.

Figure 7:
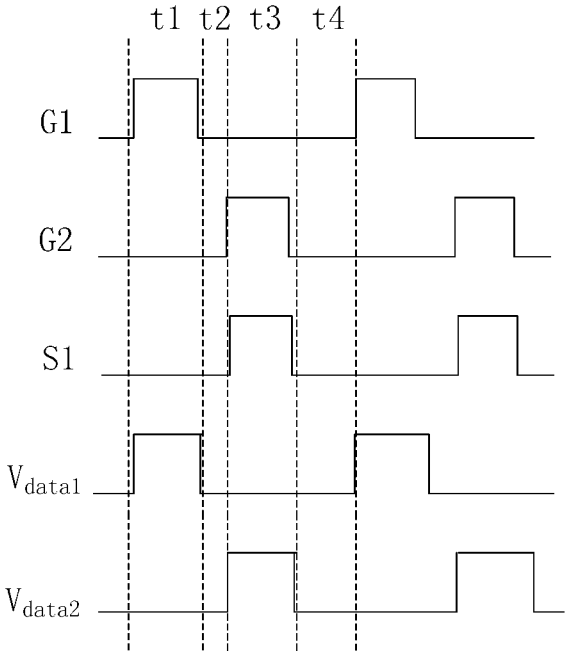
FIG. 7 illustrates a fourth sequence diagram provided by an embodiment of the present disclosure.

Referring to FIG. 7, during the time period t1, the first switch transistor T1 is switched on under the control of the first gate control signal G1, the color data signal $V_{data1}$ is transmitted to the graphene light-emitting device DTFT, and the first storage capacitor C1 is charged; the second switch transistor T2 is switched off under the control of the second gate control signal G2, and the fourth switch transistor T4 is switched off under the control of the base control signal S1.

During the time period t2, the first switch transistor T1 is switched off under the control of the first gate control signal G1, that is, the color data write unit 1 stops receiving the color data signal $V_{data1}$; the second switch transistor T2 is switched off under the control of the second gate control signal G2, and the fourth switch transistor T4 is switched off under the control of the base control signal S1.

During the time period t3, the first switch transistor T1 is switched off under the control of the first gate control signal G1; the second switch transistor T2 is switched on under the control of the second gate control signal G2, the luminance data signal $V_{data2}$ is transmitted to the third switch transistor T3, and the second storage capacitor C2 is charged. The third switch transistor T3 adjusts the value of the current signal of the graphene light-emitting device DTFT under control of the luminance data signal $V_{data2}$. Also, the fourth switch transistor T4 is switched on under the control of the base control signal S1, and the base signal $V_{ref}$ is output to the input end of the graphene light-emitting device DTFT.

During the time period t4, the first switch transistor T1 is switched off under the control of the second gate control signal G1, the second switch transistor T2 is switched off under the control of the second gate control signal G2, and the fourth switch transistor T4 is switched off under the control of the base control signal S1. The color data signal $V_{data1}$ stored in the first storage capacitor C1 and the luminance data signal $V_{data2}$ stored in the second storage capacitor C2 continue to maintain the luminance of the light with a certain color emitted by the graphene light-emitting device DTFT.

At least one embodiment of the present disclosure further provides an array substrate, comprising the above-mentioned pixel driving circuit. Because the graphene light-emitting device DTFT used in the above-mentioned pixel driving circuit can emit light with desired colors and luminance under the control of the color data signal $V_{data1}$ and the luminance data signal $V_{data2}$, and there is no need to mix light emitted by several sub-pixel units, each of which emits light with a fixed color, to obtain desired light. In this way, each pixel unit needs to correspond to only one pixel driving circuit, so that the pixel driving circuit corresponding to each pixel unit is optimized and the number of the pixel driving circuits needed for the display device is reduced. Thus, the problem of high complexity in the display panel of the display device due to too many pixel driving circuits is resolved, and the power consumption is reduced to a large extent.

At least one embodiment of the present disclosure further provides a display device, comprising the above-mentioned array substrate. Because the complexity of the above-mentioned array substrate is decreased, the usable space of the display panel becomes larger accordingly. In this way, the number of pixel driving circuits of the display panel can be increased, the display device can perform to display images with a higher display resolution, so that displayed images can possess higher realism, and the display device can achieve a better display effect.

In the description about the above-mentioned embodiments, specific features, structures, material or characteristics can be combined in any one or more of the embodiments or examples in a proper way.

What are described above is related to the illustrative embodiments of the disclosure only and not limitative to the scope of the disclosure; the scopes of the disclosure are defined by the accompanying claims.

The application claims priority to the Chinese patent application No. 201610403525.9, filed on Jun. 7, 2016, the entire disclosure of which is incorporated herein by reference as part of the present application.

What claimed is:

1. A pixel driving circuit, comprising: a color data write unit, a luminance control unit, and a graphene light-emitting device which is connected with the color data write unit and the luminance control unit, wherein the color data write unit is operative to output a color data signal to a control end of the graphene light-emitting device;

the luminance control unit is operative to receive a luminance data signal and control a value of a current signal passing the graphene light-emitting device according to the luminance data signal;

the graphene light-emitting device is operative to be driven to emit light by the color data signal and the current signal;

the luminance control unit comprises a second switch transistor, a third switch transistor and a second storage capacitor, wherein a control end of the second switch transistor is configured to receive a second gate control signal, an input end of the second switch transistor is configured to receive the luminance data signal, and an output end of the second switch transistor is connected with a control end of the third switch transistor:

an input end of the third switch transistor is connected with a second power voltage input terminal, an output end of the third switch transistor is connected with an input end of the graphene light-emitting device, and the third switch transistor is operative to control the value of the current signal of the graphene light-emitting device according to the luminance data signal; and one end of the second storage capacitor is connected with the control end of the third switch transistor, and other end of the second storage capacitor is connected with the output end of the third switch transistor.

2. The pixel driving circuit according to claim 1, wherein the color data write unit comprises a first switch transistor and a first storage capacitor, wherein a control end of the first switch transistor is configured to receive a first gate control signal, and an input end of the first switch transistor is configured to receive the color data signal, and an output end of the first switch transistor is connected with the control end of the graphene light-emitting device;

one end of the first storage capacitor is connected with the output end of the first switch transistor, and other end of the first storage capacitor is connected with a first power voltage input terminal.

3. The pixel driving circuit according to claim 2, wherein the pixel driving circuit further comprises a base control unit, the base control unit is connected with the input end of the graphene light-emitting device, and the base control unit is operative to output a base signal to the input end of the graphene light-emitting device.

4. The pixel driving circuit according to claim 3, wherein the base control unit comprises a fourth switch transistor, a control end of the fourth switch transistor is configured to receive a base control signal, an input end of the fourth switch transistor is configured to receive the base signal, and an output end of the fourth switch transistor is connected with the input end of the graphene light-emitting device.

5. The pixel driving circuit according to claim 1, wherein the pixel driving circuit further comprises a base control unit, the base control unit is connected with the input end of the graphene light-emitting device, and the base control unit is operative to output a base signal to the input end of the graphene light-emitting device.

6. The pixel driving circuit according to claim 5, wherein the base control unit comprises a fourth switch transistor, a control end of the fourth switch transistor is configured to receive a base control signal, an input end of the fourth switch transistor is configured to receive the base signal, and an output end of the fourth switch transistor is connected with the input end of the graphene light-emitting device.

7. An array substrate, comprising the pixel driving circuit of claim 1.

8. A display device, comprising the array substrate of claim 7.

9. A pixel driving circuit, comprising: a color data write unit, a luminance control unit, and a graphene light-emitting device which is connected with the color data write unit and the luminance control unit, wherein the color data write unit is operative to output a color data signal to a control end of the graphene light-emitting device;

the luminance control unit is operative to receive a luminance data signal and control a value of a current signal passing the graphene light-emitting device according to the luminance data signal;

the graphene light-emitting device is operative to be driven to emit light by the color data signal and the current signal;

the luminance control unit comprises a second switch transistor, a third switch transistor and a second storage capacitor, wherein a control end of the second switch transistor is configured to receive a second gate control signal, an input end of the second switch transistor is configured to receive the luminance data signal, and an output end of the second switch transistor is connected with a control end of the third switch transistor;

an input end of the third switch transistor is connected with an output end of the graphene light-emitting device, an output end of the third switch transistor is connected with a first power voltage input terminal, and the third switch transistor is operative to control the value of the current signal of the graphene light-emitting device according to the luminance data signal; and one end of the second storage capacitor is connected with the control end of the third switch transistor, and other end of the second storage capacitor is connected with the output end of the third switch transistor.

10. The pixel driving circuit according to claim 9, wherein the color data write unit comprises a first switch transistor and a first storage capacitor, wherein a control end of the first switch transistor is configured to receive a first gate control signal, and an input end of the first switch transistor is configured to receive the color data signal, and an output end of the first switch transistor is connected with the control end of the graphene light-emitting device;

one end of the first storage capacitor is connected with the output end of the first switch transistor, and other end of the first storage capacitor is connected with a first power voltage input terminal.

11. An array substrate, comprising the pixel driving circuit of claim 9.

12. A display device, comprising the array substrate of claim 11.

13. A driving method of a pixel driving circuit, the pixel driving circuit comprising a color data write unit, a luminance control unit, and a graphene light-emitting device which is connected with the color data write unit and the luminance control unit; the driving method comprising driving cycles and each driving cycle comprising:

a color-data-writing period, during which the color data write unit transmits a color data signal to a control end of the graphene light-emitting device;

a luminance-controlling period, during which the luminance control unit receives a luminance data signal and controls a value of a current signal passing the graphene light-emitting device according to the luminance data signal; and a light-emitting period, during which the graphene light-emitting device is driven to emit light by the color data signal and the current signal, wherein the luminance control unit comprises a second switch transistor, a third switch transistor and a second storage capacitor, a control end of the second switch transistor is configured to receive second gate control signal, a input of the second switch transistor configured to receive the luminance data signal, and an output end of the second switch transistor is connected with a control end of the third switch transistor:

an input end of the third switch transistor is connected with a second power voltage input terminal, an output end of the third switch transistor is connected with an input end of the graphene light-emitting device, and the third switch transistor is operative to control the value of the current signal of the graphene light-emitting device according to the luminance data signal; and one end of the second storage capacitor is connected with, the control end of the third switch transistor, and other end of the second storage capacitor is connected with the output end of the third switch transistor.

14. The driving method of a pixel driving circuit according to claim 13, wherein the color-data-writing period and the luminance-controlling period are carried out concurrently, or the color-data-writing period and the luminance-controlling period are carried out in sequence.

15. The driving method of a pixel driving circuit according to claim 14, wherein when the color-data-writing period and the luminance-controlling period are carried out in sequence, a buffer period is included between the color-data-writing period and the luminance-controlling period; and during the buffer period, the color data write unit stops receiving the color data signal.

16. The driving method of a pixel driving circuit according to claim 15, wherein when the luminance control unit is connected with an input end of the graphene light-emitting device, the pixel driving circuit further comprises a base control unit;

the base control unit is connected with the input end of the graphene light-emitting device, and during the luminance-controlling period the base control unit outputs a base signal to the input end of the graphene light-emitting device.

17. The driving method of a pixel driving circuit according to claim 14, wherein when the luminance control unit is connected with an input end of the graphene light-emitting device, the pixel driving circuit further comprises a base control unit;

the base control unit is connected with the input end of the graphene light-emitting device, and during the luminance-controlling period the base control unit outputs a base signal to the input end of the graphene light-emitting device.

18. The driving method of a pixel driving circuit according to claim 13, wherein when the luminance control unit is connected with an input end of the graphene light-emitting device, the pixel driving circuit further comprises a base control unit;

the base control unit is connected with the input end of the graphene light-emitting device, and during the luminance-controlling period the base control unit outputs a base signal to the input end of the graphene light-emitting device.

* * * * *